United States Patent [19]

Witte

[11] Patent Number: 4,612,963

[45] Date of Patent: Sep. 23, 1986

[54] MACHINE FOR MAKING WIRE COMB BINDERS

[75] Inventor: Fritz Witte, Wendlingen, Fed. Rep. of Germany

[73] Assignee: Womako Maschinenkonstruktionen GmbH, Nürtingen, Fed. Rep. of Germany

[21] Appl. No.: 578,666

[22] Filed: Feb. 9, 1984

[30] Foreign Application Priority Data

Feb. 21, 1983 [DE] Fed. Rep. of Germany ..... 3305946

[51] Int. Cl.[4] ..... B21F 1/00

[52] U.S. Cl. ..... 140/105; 226/158

[58] Field of Search ..... 140/105, 41.5, 147; 226/124, 180, 117, 118, 160, 158, 159, 187, 189; 74/54

[56] References Cited

U.S. PATENT DOCUMENTS

| | | | |
|---|---|---|---|
| 819,649 | 5/1906 | Ham | 74/54 |
| 2,358,595 | 9/1944 | Robbins | 74/54 |
| 2,737,212 | 3/1956 | Huszar | 140/105 |
| 3,106,749 | 10/1963 | Streicher | 140/105 |
| 4,047,544 | 9/1977 | Seaborn et al. | 140/105 |
| 4,165,767 | 8/1979 | Seaborn et al. | 140/105 |
| 4,281,690 | 8/1981 | Lemburg | 140/71 |

FOREIGN PATENT DOCUMENTS 8133321 11/1982 Fed. Rep. of Germany .

*Primary Examiner*—Francis S. Husar
*Assistant Examiner*—Robert Showalter
*Attorney, Agent, or Firm*—Peter K. Kontler

[57] ABSTRACT

A machine wherein wire is being withdrawn from a reel or barrel by a wire comb forming unit which draws the wire at a given frequency has a lever which is pivoted at such frequency by a rotary cam and carries a first roller. The lever is pivotable about the axis of a second roller and the wire is trained first over the second roller and thereupon around the first roller on its way toward the wire comb forming unit. The pivoting lever ensures that the wire is drawn from the reel or barrel at a constant speed in spite of intermittent consumption of wire in the wire comb forming unit. The diameters of the two rollers are the same.

8 Claims, 1 Drawing Figure

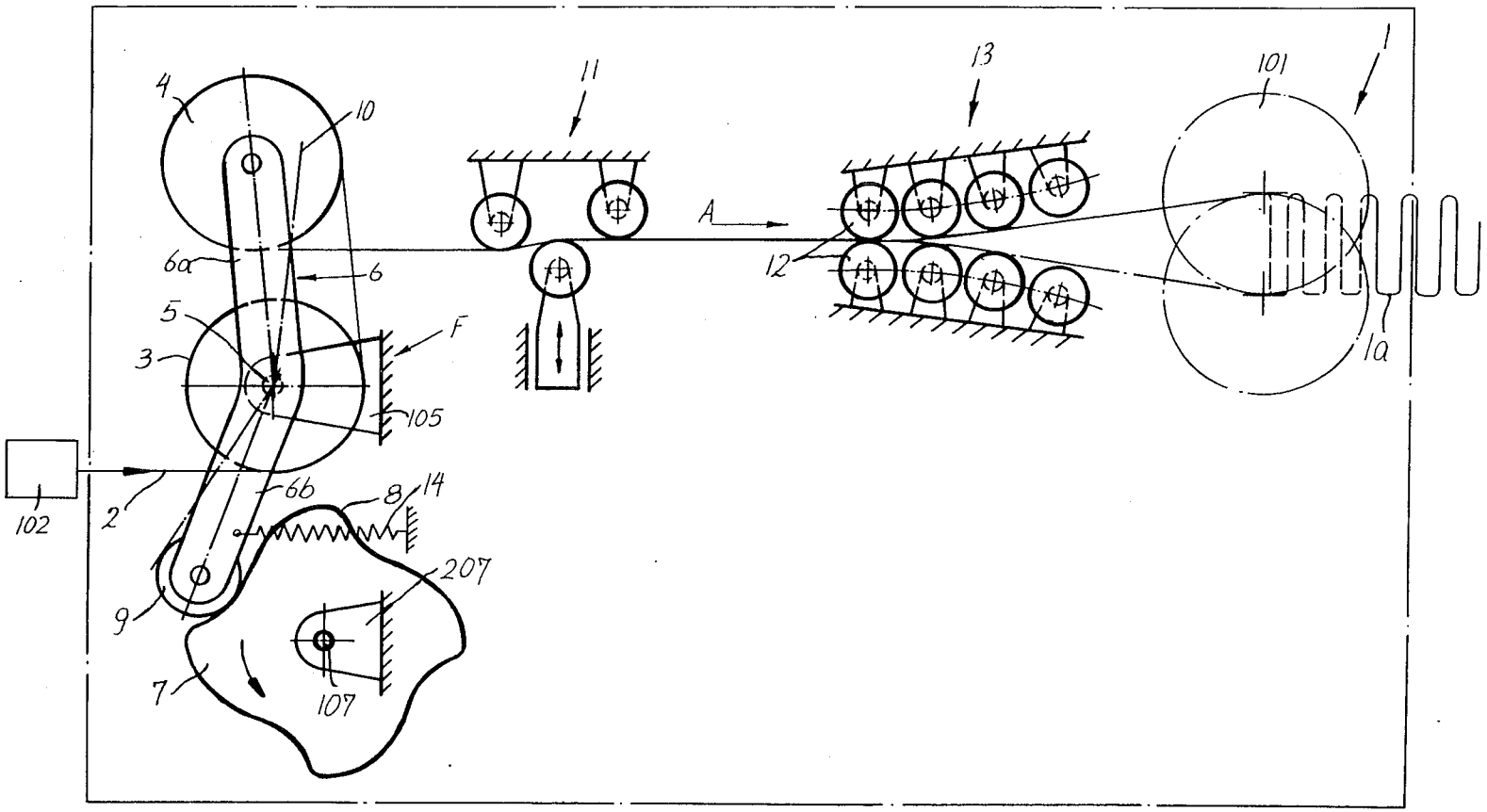
1
1a
101
13
12
A
11
F
105
14
207
8
10
6
6b
107
6a
5
3
4
2
9
7
102

MACHINE FOR MAKING WIRE COMB BINDERS

BACKGROUND OF THE INVENTION

The present invention relates to wire shaping machines in general, and more particularly to improvements in machines for making so-called wire comb binders which can be used to hold together the sheets of steno pads, calendars, exercise books and analogous stationery or bookstore products.

A machine which makes wire comb binders includes a first unit which draws wire from a suitable source and converts the withdrawn wire into an undulate intermediate product (wire comb) with a series of neighboring elongated components resembling the teeth or prongs of a comb. The thus deformed wire is thereupon introduced into a second unit wherein the prong-shaped components are bent into C-shape to form a series of coherent binders which are ready to be inserted into perforations in the marginal portions of stacked paper sheets or the like. The first unit may be of the type disclosed in German Utility Model No. 81 33 321.8, and the second unit may be of the type disclosed in U.S. Pat. No. 4,047,544.

The mode of operation of present popular wire comb forming units is such that they draw wire intermittently from a reel or a barrel whereon or wherein the wire is stored in the form of convolutions surrounding a suitable core. Intermittent withdrawal of wire from such sources entails continuous changes in tensional stressing of the wire and attendant agitation of convolutions in the source of supply. Such agitation is undesirable because it can affect the quality of the wire-deforming action in the wire comb forming or even in the binder forming unit of the machine.

OBJECTS AND SUMMARY OF THE INVENTION

An object of the invention is to provide a wire comb forming and wire comb binder forming machine wherein the wire can be withdrawn from a suitable source at a constant rate.

Another object of the invention is to provide the machine with a novel and improved apparatus which ensures continuous withdrawal of wire from the source of supply even though the wire comb forming unit of the machine draws and processes wire intermittently.

A further object of the invention is to provide a novel and improved operative connection between such apparatus and the wire comb forming unit.

An additional object of the invention is to provide an apparatus which ensures that the tensional stress upon those increments of wire which are being withdrawn from the source of supply is constant irrespective of the rate at which the withdrawn wire is processed in the wire comb forming unit.

Another object of the invention is to provide a machine wherein the supply of wire from which such material is drawn into the wire comb forming unit is not affected by intermittent operation of such unit.

Still another object of the invention is to provide a novel and improved method of manipulating wire on its way from a source to the wire comb forming unit of a wire binder making machine.

A further object of the invention is to provide the machine with novel and improved means for guiding the wire upstream of the wire comb forming unit.

The invention is embodied in a machine which converts a continuous length of wire (which can be a metallic wire, a plastic wire or a plastic-coated metallic wire) into a continuous comb-like undulate product and wherein the wire advances along an elongated path from a source of supply (such as a reel or a barrel) to a deforming unit which includes means for intermittently drawing predetermined unit lengths of wire at a predetermined frequency in a direction from the source. More particularly, the invention is embodied in an apparatus which converts intermittent advances of wire under the action of the deforming unit (such as the aforediscussed wire comb making or forming unit) into an uninterrupted movement of the wire from the source. The apparatus comprises a lever, a fixed fulcrum for the lever, means for pivoting the lever with reference to the fulcrum at the aforementioned predetermined frequency (i.e., in synchronism with the operation of the deforming unit), a first roller or an analogous rotary member whose axis coincides with the pivot axis of the lever, and a second roller or an analogous rotary member which is rotatably mounted on and is rockable by (i.e., pivotable with) the lever. The wire in the path between the source and the deforming unit is trained first over the first rotary member and thereupon over the second rotary member, as considered in the direction of movement of the wire toward the deforming unit. The diameters of the rotary members are identical.

The pivoting means preferably comprises a rotary cam which is tracked by a roller follower of the lever. The cam has at least one lobe which is arranged to pivot the lever, and the pivoting means further comprises means for rotating the cam at a constant angular velocity so that the lobe pivots the lever at the aforementioned frequency. If the cam has two or more (e.g., four) equidistant lobes, the angular velocity of the cam is reduced so that the lobes together pivot the lever at the aforementioned frequency. The lever can constitute a two-armed lever; one of its arms rotatably supports the second rotary member and the other arm rotatably supports the follower which tracks the cam.

The apparatus preferably further comprises wire straightening means downstream of the second rotary member to straighten successive increments of the wire on their way to the deforming unit. Such apparatus preferably further comprises wire guide means downstream of the straightening means, as considered in the direction of advancement of wire toward the deforming unit. Such guide means can comprise a series of pairs of rolls which flank the path for the wire. The rolls of each successive pair of the series are more distant from one another than the rolls of the preceding pair; this allows for but prevents excessive oscillations of wire under the action of the constituents of the deforming unit.

The means for rotating the cam is preferably driven by a element of the deforming unit or by the prime mover which drives the deforming unit. The movements of the cam are synchronized with the operation of the deforming unit in the aforedescribed manner, i.e., so that the cam pivots the lever and hence the second rotary member about the axis of the first rotary member at the aforementioned frequency.

The novel features which are considered as characteristic of the invention are set forth in particular in the appended claims. The improved apparatus itself, however, both as to its construction and its mode of operation, together with additional features and advantages thereof, will be best understood upon persual of the following detailed description of certain specific embodiments with reference to the accompanying drawing.

BRIEF DESCRIPTION OF THE DRAWING

The single FIGURE of the drawing is a schematic elevational view of a wire comb binder making machine which embodies one form of the improved apparatus.

DESCRIPTION OF THE PREFERRED EMBODIMENTS

The machine which is illustrated in the drawing comprises a suitable source 102 of wire 2. The source 102 can constitute a barrel for a supply of loosely convoluted wire or a reel having a core which is loosely surrounded by the convolutions of the wire. The source 102 supplies wire 2 to a deforming unit 1 which is or can be of the type disclosed in U.S. Pat. No. 4,165,767, The disclosure of this patent, as well as all other U.S. patents referred to herein, is incorporated by reference. A characteristic feature of the deforming unit 1 is that it withdraws predetermined unit lengths of wire 2 intermittently at a predetermined frequency in order to convert the originally straight wire into an undulate intermediate product (flat wire comb) which is ready to be converted into a series of coherent C-shaped wire comb binders of the type disclosed, for example, in U.S. Pat. No. 4,281,690.

In accordance with the invention, the machine which includes the wire deforming unit 1 further comprises an apparatus which ensures that the wire 2 is withdrawn from the source 102 at a constant speed and is subjected to unchanging tensional stress in spite of intermittent processing of such wire in the deforming unit 1. The improved apparatus comprises a two-armed lever 6 which is fulcrumed at 5 so as to be pivotable or rockable back and forth about a fixed axis. The fulcrum 5 is mounted in a stationary bearing 105 which is mounted in or on the frame F of the machine. The apparatus further comprises a first rotary member 3 (e.g., a roller or pulley) whose axis coincides with the pivot axis of the lever 6, a second rotary member 4 (which can constitute a roller or a pulley and whose diameter is identical with that of the roller 3) mounted on the arm **6*a* of the lever 6, a relatively small roller follower 9 which is rotatably mounted on the arm 6*b* of the lever 6, a rotary disc-shaped cam 7 which constitutes a component of means for pivoting the lever 6 at the frequency at which the deforming unit 1 draws unit lengths of wire 2 in the direction of arrow A, and a shaft 107 which is preferably an element of the deforming unit 1 and rotates the cam 7 at a constant angular velocity such that the lever 6 is pivoted at the aforementioned frequency. The shaft 107 is mounted in fixed bearings 207 and has four equidistant raised portions or lobes 8. The roller follower 9 tracks the peripheral surface of the cam 7. The shaft 107 can carry a rotary deforming element (e.g., a looping member) 101 of the deforming unit 1 which must turn through 90° in response to or simultaneously with each advancement of the wire 2 by a step of unit length. Accordingly, the cam 7 has four equidistant lobes 8 to ensure that the lever 6 is pivoted once during each stepwise advancement of wire 2 into the deforming unit 1. A suitable spring 14 is provided to ensure that the follower 9 remains in permanent contact with the peripheral surface of the cam 7**.

As can be seen in the drawing, the wire 2 in the path between the source 102 and the deforming unit 1 is trained first over the rotary member 3 and thereupon over the rotary member 4. The purpose of the improved apparatus is to ensure that the varying speed $V_a$ of the wire 2 in the deforming unit 1 (such varying speed is the necessary result of the aforediscussed intermittent operation of the unit 1 insofar as the consumption or processing of wire 2 is concerned) is converted into a constant speed $V_e$ in the region of the source 102, namely between the source 102 and the locus where successive increments of the wire 2 move out of contact with the rotary member 4.

The apparatus further comprises a suitable wire straightening unit 11 which is adjacent to the path of wire 2 downstream of the rotary member 4 and straightens the wire in order to eliminate the deformation that is caused by training the wire around the rotary members 3 and 4. The straightening unit 11 is followed by a wire guiding unit 13 including a series of pairwise arranged rolls 12. The rolls 12 of each next-following pair (as considered in the direction of arrow A) are more distant from one another than the rolls 12 of the preceding pair. This enables the wire 2 to swing back and forth (up and down as viewed in the drawing) only to the extent which is required for proper operation of the deforming unit 1.

The operation is as follows:

The shaft 107 of the cam 7 is driven in synchronism with the operation of the deforming unit 1 so as to rotate at a constant angular velocity. Each withdrawal of wire 2 by the intermittently operating deforming unit 1 in the direction of arrow A entails a pivotal movement of the lever 6 under the action of one of the lobes 8 on the cam 7 whereby the arm **6*a* moves to the position which is indicated by the phantom line 10, i.e., the rotary member 4 moves in the direction of arrow A toward the wire straightening device 11. The lever 6 pivots about the fixed axis of the rotary member 3. The arm 6*a* assumes the phantom-line position 10 whenever the roller follower 9 on the arm 6*b* of the lever 6 engages the apex of one of the lobes 8. The spring 14 thereupon pivots the lever 6 in the opposite direction (toward the position which is shown in the drawing by solid lines) so that the rotary member 4 moves counter to the direction which is indicated by arrow A. The rotary members 3 and 4 rotate at a constant peripheral speed in a counterclockwise direction, as viewed in the drawing, either under the action of the deforming unit 1 while the latter draws wire 2 through straightening and guiding units 11, 13 or under the action of the lever 6 which moves the rotary member 4 counter to the direction which is indicated by the arrow A. Such movements of the lever 6 under the action of the deforming unit 1 (i.e., under the action of the cam 7) and under the action of the spring 14 ensure that the intermittent advancement of wire 2 at the speed $v_a$ (under the action of the deforming unit 1) is converted into a constant-speed movement $v_e$ in the region between the source 102 and the rotary member 4. The peripheral speed of the rotary members 3 and 4 is the same because the diameters of these rotary members are identical. The rotary member 3 is driven at the speed of the rotary member 4 by the wire 2 which is pulled by the rotary member 4, either under the action of the deforming unit 1 or while the lever 6 is pivoted by the spring 14. Since the peripheral speed of the rotary members 3 and 4 is constant, that length of the wire 2** which extends between the source 102 and the rotary members 3, 4 is not subject to any acceleration or deceleration and the tensional stress upon such length of wire remains constant. In other words, the pull upon such length of wire is constant at all times. This ensures that the supply of wire in the source 102 is neither agitated nor otherwise affected in a sense to adversely influece the wire deforming action of the unit 1. Otherwise stated, the rotary members 3 and 4 do not apply to the wire 2 any additional mass forces.

An important advantage of the improved apparatus is that the intermittent operation of the deforming unit 1 cannot affect the state of the wire in the source 102 and, therefore, the condition of the wire in such source cannot adversely influence the deforming operation of the unit 1. This is achieved in that the rotary members 3 and 4 subject the wire in the upstream portion of the path between the source 102 and the deforming unit 1 to a constant tensional stress. The application of constant tensional stress eliminates oscillations or other undesirable stray movements of the wire as well as other undesirable results of repeated changes in the magnitude of tensional stress upon the wire.

Another important advantage of the improved apparatus is its simplicity and compactness. Such apparatus can be installed in existing machines for the making of stationery and printed products to stabilize the operation of the wire deforming unit and to contribute to superior quality of the binders. This simplifies the insertion of such binders into the perforations of stacked paper sheets or the like.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. In a machine for converting a continuous length of wire into a continuous comb-like product wherein the wire advances along an elongated path from a source of supply to a deforming unit which includes means for intermittently drawing predetermined unit lengths of wire at a predetermined frequency in a direction from such source, apparatus for converting intermittent advances of the wire under the action of the deforming unit into an uninterrupted movement of the wire from the source, comprising a lever having follower means; a fixed fulcrum for said lever; means for pivoting said lever with reference to said fulcrum at said predetermined frequency, including a rotary cam which is tracked by said follower means; a first rotary member having an axis coinciding with the pivot axis of said lever; and a second rotary member rotatably mounted on and pivotable with said lever, the wire which advances along said path being trained first around said first rotary member and thereupon around said second rotary member, as considered in said direction.

2. The apparatus of claim 1, wherein said rotary members have identical diameters.

3. The apparatus of claim 1, wherein said cam has at least one lobe which is arranged to pivot said lever, and further comprising means for rotating said cam at a constant angular speed so that said lobe pivots said lever at said frequency.

4. The apparatus of claim 3, wherein said cam has a plurality of equidistant lobes.

5. The apparatus of claim 3, wherein said lever has two arms, said second rotary member being mounted on one of said arms and said follower means being mounted on the other of said arms.

6. The apparatus of claim 1, further comprising wire straightening means adjacent to said path downstream of said second rotary member, as considered in said direction.

7. The apparatus of claim 1, further comprising wire guide means adjacent to said path downstream of said second rotary member, as considered in said direction.

8. The apparatus of claim 7, wherein said guide means comprises a series of pairs of rolls flanking said path, the rolls of each successive pair of said series being more distant from one another than the rolls of the preceding pair.

* * * * *